US010109909B1

(12) United States Patent
Rowson et al.

(10) Patent No.: US 10,109,909 B1
(45) **Date of Patent: *Oct. 23, 2018**

(54) ANTENNA WITH PROXIMITY SENSOR FUNCTION

(71) Applicant: Ethertronics, Inc., San Diego, CA (US)

(72) Inventors: Sebastian Rowson, San Diego, CA (US); Laurent Desclos, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/263,270

(22) Filed: Sep. 12, 2016

Related U.S. Application Data

(63) Continuation-in-part of application No. 13/965,101, filed on Aug. 12, 2013, now Pat. No. 9,478,870.

(60) Provisional application No. 61/682,145, filed on Aug. 10, 2012.

(51) Int. Cl.

| | |
|---|---|
| ***H01Q 1/24*** | (2006.01) |
| ***H01Q 1/48*** | (2006.01) |
| ***H01Q 1/38*** | (2006.01) |
| ***H01Q 1/22*** | (2006.01) |

(52) U.S. Cl.
CPC ..... *H01Q 1/245* (2013.01); *H01Q 1/2258* (2013.01); *H01Q 1/38* (2013.01); *H01Q 1/48* (2013.01)

(58) Field of Classification Search
CPC H01Q 1/48; H01Q 25/04; H01Q 1/24; H01Q 1/22; H01Q 1/36
USPC ..... 343/745
See application file for complete search history.

(56) References Cited

U.S. PATENT DOCUMENTS

| | | | | |
|---|---|---|---|---|
| 6,351,215 | B2 * | 2/2002 | Rodgers | G01S 13/753 340/572.1 |
| 6,765,536 | B2 | 7/2004 | Phillips et al. | |
| 6,987,493 | B2 | 1/2006 | Chen | |
| 7,003,519 | B1 | 2/2006 | Biettron | |
| 7,068,234 | B2 | 6/2006 | Sievenpiper | |
| 7,180,464 | B2 * | 2/2007 | Chiang | H01Q 1/242 343/702 |
| 7,215,289 | B2 | 5/2007 | Harano | |
| 7,830,320 | B2 | 11/2010 | Shamblin et al. | |
| 7,834,813 | B2 * | 11/2010 | Caimi | H01Q 9/045 343/745 |
| 7,911,402 | B2 | 3/2011 | Rowson et al. | |
| 8,325,097 | B2 * | 12/2012 | McKinzie, III | H01Q 9/0442 343/703 |
| 8,362,962 | B2 | 1/2013 | Rowson et al. | |
| 8,446,318 | B2 | 5/2013 | Ali et al. | |
| 8,648,755 | B2 | 2/2014 | Rowson et al. | |
| 8,717,241 | B2 | 5/2014 | Shamblin et al. | |

(Continued)

*Primary Examiner* — Huedung Mancuso
(74) *Attorney, Agent, or Firm* — Dority & Manning, P.A.

(57) ABSTRACT

The disclosure concerns an antenna with proximity sensor function. The antenna and proximity sensors can be implemented in a laptop computer, and proximity sensor loading states are surveyed and used to determine when and to what degree to alter the reactance at the junction of or along the parasitic element to optimize the frequency response and/or the impedance properties of the antenna system. An algorithm or look-up table is configured to relate proximity sensor loading states to reactance required to alter antenna characteristics.

9 Claims, 7 Drawing Sheets

(56) References Cited

U.S. PATENT DOCUMENTS

| | | | |
|---|---|---|---|
| 8,928,540 | B2 | 1/2015 | Desclos |
| 9,240,634 | B2 | 1/2016 | Rowson et al. |
| 9,439,151 | B2 | 9/2016 | Zhu et al. |
| 2005/0264455 | A1 | 12/2005 | Talvitie |
| 2006/0017635 | A1 | 1/2006 | Zheng |

* cited by examiner

Example of antenna with integrated proximity sensors

Example of antenna with integrated proximity sensors
Flex circuit material used to position three proximity sensors on an antenna element.

ANTENNA WITH PROXIMITY SENSOR FUNCTION

CROSS-REFERENCE TO RELATED APPLICATIONS

This application is a continuation in part of U.S. Ser. No. 13/965,101, filed Aug. 12, 2013;

which claims benefit of priority with U.S. Provisional Ser. No. 61/682,145, filed Aug. 10, 2012;

the contents of each of which are hereby incorporated by reference.

BACKGROUND OF THE INVENTION

Field of the Invention

This invention relates to antennas for use in wireless communications; and more particularly, to an antenna with proximity sensor function.

Description of the Related Art

Proximity sensors are in use in commercial wireless devices as well as other product groups, and are used for a wide variety of applications. For example, it is common for a proximity sensor to be integrated into a cell phone, with the proximity sensor used to sense when the display region of the cell phone is in close proximity to an object. This sensing of an object close to the display is used to reduce battery power consumption by turning off or down the brightness of the display when the display is in close proximity to a user's head or the display is covered by an object. Another application of a proximity sensor is to integrate the sensor into a Tablet computing device and use the sensor to sense proximity of the user's body to the Tablet. When the user's body is close to the Tablet, the transmit power of the cellular transceiver is reduced to allow the Tablet to meet requirements for specific absorption rate (SAR).

One implementation of a proximity sensor is a capacitive sensor, and is effectively a parallel plate capacitor. A dielectric material is positioned between the two plates to provide support and maintain a set separation distance between the plates. Two conductors are used to connect the two plates to a circuit that monitors capacitance. As objects are placed in proximity to the capacitor the objects interact with the fringing electric field emanating from the region between and external to the plates. This interference with the fringing fields of the capacitor translates into a change in capacitance.

Multiple proximity sensors can be integrated into a device and used to provide more information on the environment and changes to the environment. Multiple problems arise in integrating proximity sensors into a device such as finding volume for the proximity sensors, incurring the cost of the sensors, and positioning the sensors at locations that are desirable, such as close to the antenna system.

SUMMARY OF THE INVENTION

An antenna with proximity sensor function is disclosed, the antenna includes at least one parasitic element coupled to a filter circuit and a proximity sensing circuit for sensing a load on the parasitic element to determine capacitive loading characteristics for sensing user loading of the device. By sensing the user loading, or mode of the device, the antenna can be reconfigured with beam steering or frequency shifting adjustments.

DETAILED DESCRIPTION OF THE PREFERRED EMBODIMENTS

Figure 1:
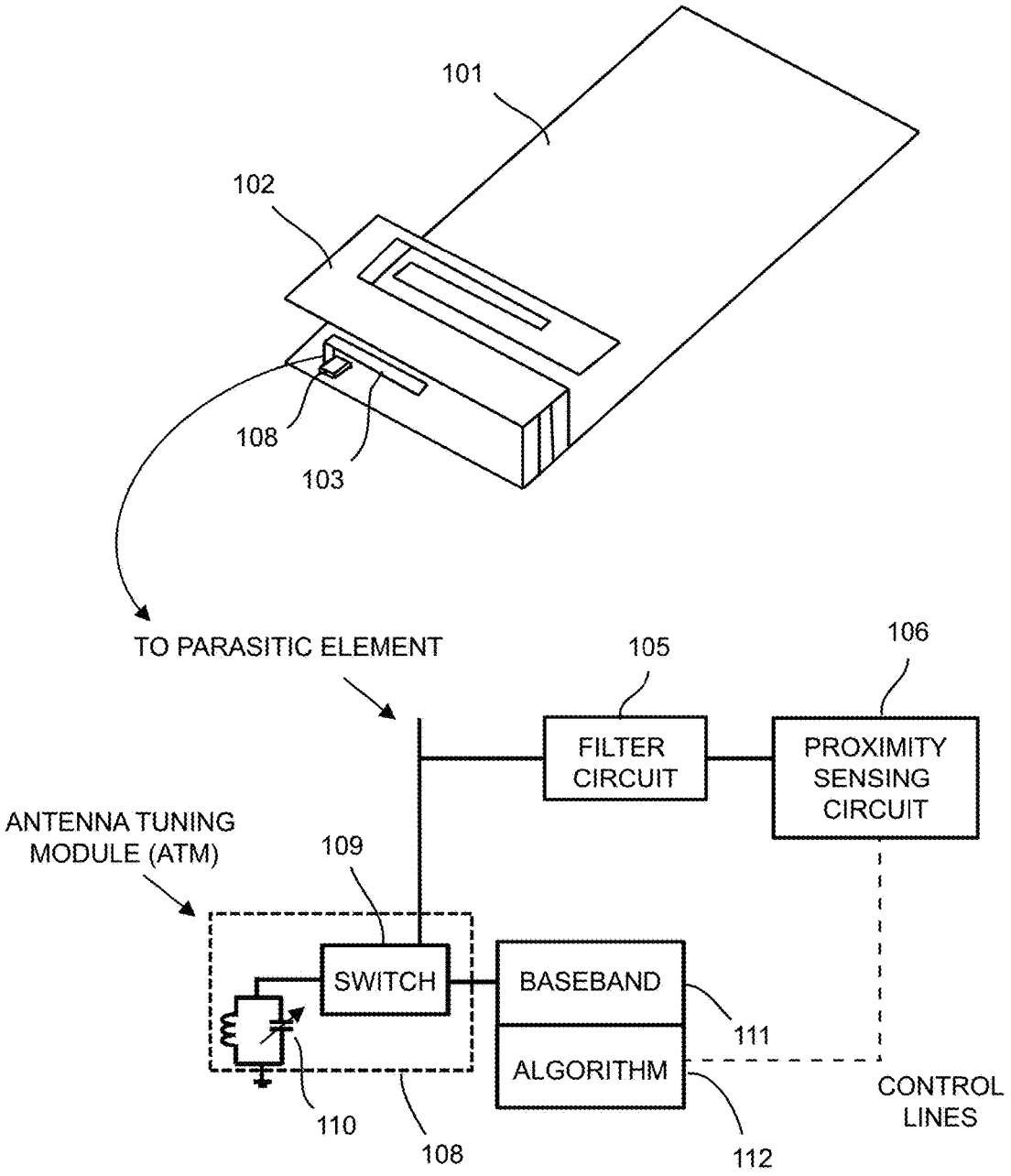
FIG. 1 shows an antenna with proximity sensor function in accordance with an embodiment.

A proximity sensor can be positioned beside or beneath an antenna and the antenna can be re-tuned to compensate for the effect of placing the metal conductors near the antenna. A more efficient method in terms of maintaining antenna performance, reducing volume required, and saving cost is to design the proximity sensor into the antenna structure. This combination antenna and proximity sensor provides a more optimized and cost effective solution for devices that require antennas and proximity sensing systems. More importantly, by designing the proximity sensor, or multiple proximity sensors into the antenna, the ability to detect changes to the environment in the region of the antenna can be improved. Sensing when objects are in close proximity to an antenna can be used to assist in re-tuning the antenna and keeping the antenna impedance optimized.

In certain embodiments a parasitic element is positioned beneath a radiating antenna element, with this parasitic element used to shift the frequency response of the antenna. A second active antenna topology developed consists of a parasitic element positioned in close proximity but outside of the volume of the main antenna, with this "offset" parasitic element used to alter the radiation mode, and in turn the pattern characteristics of the main antenna. These modal antennas are capable of beam-steering and band-switching and are further described in U.S. Ser. No. 13/726,477, filed Dec. 24, 2012; which is related to U.S. Pat. No. 8,362,962, issued Jan. 29, 2013; and U.S. Pat. No. 7,911,402, issued Mar. 22, 2011; each of which are commonly owned and their contents are hereby incorporated by reference. The parasitic elements described in these examples can also be used as a proximity sensor. The parasitic element can be coupled using a filter circuit to separate the high frequency RF component at the frequency of operation of the antenna from the low frequency signal required for the proximity sensing function. The parasitic element can be designed to operate as a proximity sensor by using blocking capacitors to isolate the parasitic element from ground at DC and present a high impedance at the lower frequencies used for proximity sensing.

In one embodiment, an antenna element is coupled to a ground plane with a parasitic element beneath the antenna element. The parasitic element is configured to shift the frequency response of the antenna when a reactive load or change in reactance is applied to the parasitic element at the junction of the parasitic element and the ground plane, or at locations along the parasitic element. A filtering circuit is coupled to the parasitic element, with the filtering circuit connecting the parasitic element to a proximity sensing circuit.

In an embodiment, two or more parasitic elements are positioned beneath the antenna element, and one or more of the parasitic elements is connected to a filtering circuit which in turn is connected to a proximity sensing circuit.

In another embodiment, an antenna element is coupled to a ground plane with a parasitic element positioned in close proximity to the antenna element. The parasitic element is configured to alter the radiation mode of the antenna, which in turn will alter the radiation pattern characteristics of the antenna. The radiation mode is altered when a reactive load or change in reactance is applied to the parasitic element at the junction of the parasitic element and the ground plane, or at locations along the parasitic element. A filtering circuit is coupled to the parasitic element, with the filtering circuit connecting the parasitic element to a proximity sensing circuit.

In another embodiment, an antenna is positioned in proximity to a ground plane wherein the antenna is not connected to the ground plane. A filtering circuit is coupled to the antenna, with the filtering circuit connecting the antenna to a proximity sensing circuit. The antenna can be used for transmission and/or receiving RF signals and the antenna structure acts as a proximity sensor.

In yet another embodiment, an antenna is provided wherein conductors are attached at multiple locations; with these conductors coupled to one or more filter circuits to couple the conductors to a proximity sensing circuit.

Now turning to the drawings, FIG. 1 shows an antenna with proximity sensor function in accordance with an embodiment. The antenna is implemented as an active modal antenna described above, having an antenna radiator 102 positioned above a ground plane 101 forming an antenna volume therebetween. A parasitic element 103 is positioned within the antenna volume. The parasitic element 103 is coupled to an antenna tuning module (ATM) 108 and a filter circuit 105. The ATM 108 comprises a switch 109 and one or more tunable components including tunable capacitors 110, tunable inductors, or tunable phase shifters. The ATM is further coupled to a baseband processor 111 or a separate processor with an algorithm 112 for controlling the parasitic element 103. The filter circuit 105 is coupled to a proximity sensing circuit 106 and algorithm 107 for sensing capacitive load on the parasitic element as a mechanism for sensing proximity of user extremities.

Figure 2:
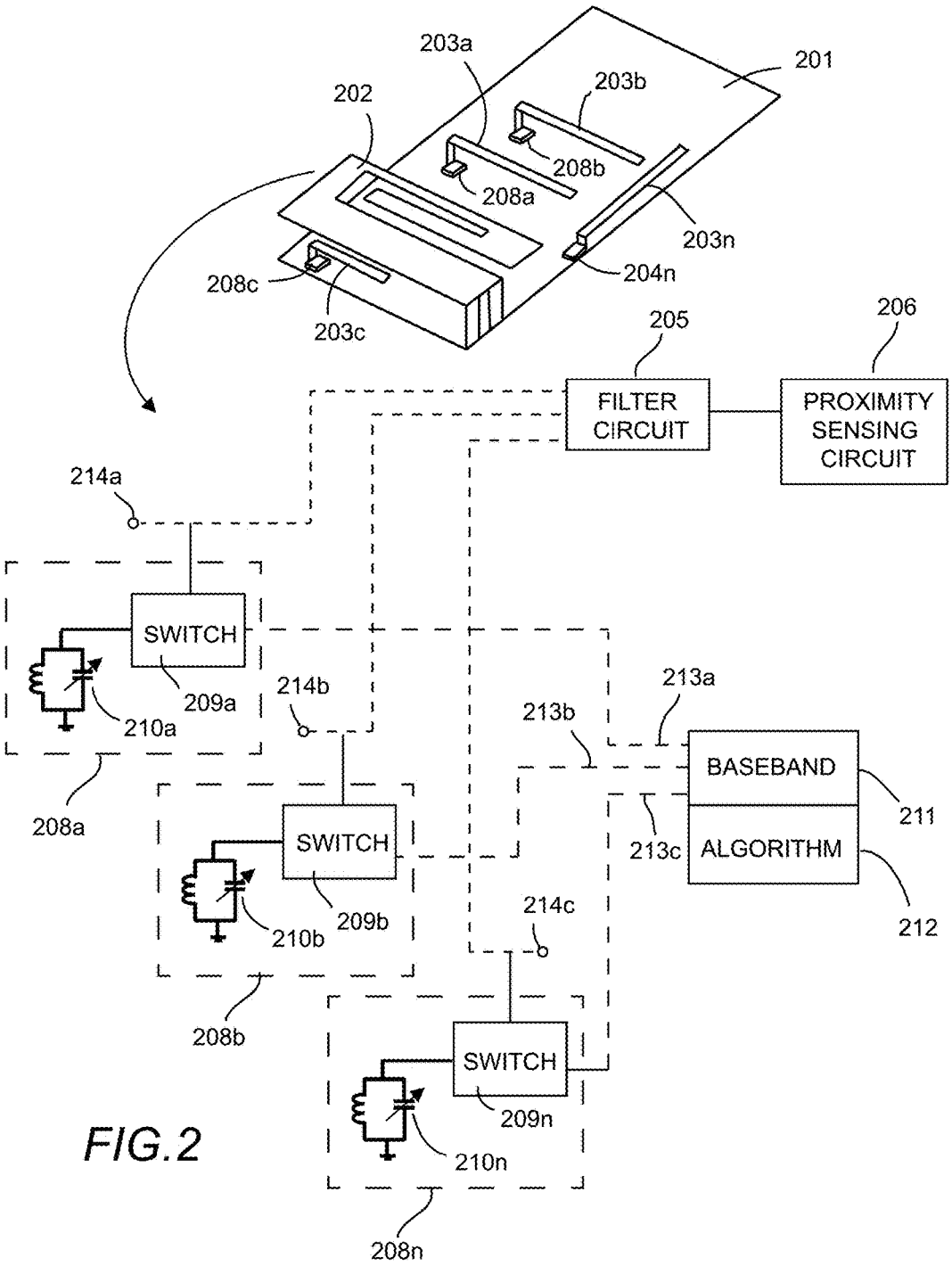
FIG. 2 shows an active modal antenna with n parasitic elements and proximity sensors in accordance with another embodiment.

FIG. 2 shows an active modal antenna with n parasitic elements and proximity sensors in accordance with another embodiment. This embodiment is similar to FIG. 1 having an antenna radiator 202 positioned above a ground plane 201, and first parasitic element 203*a* adjacent to the antenna radiator, but with the additional parasitic elements 203*b*; 203*c*; and 203*n*, respectively. One parasitic element is shown within the antenna volume, and three additional parasitic elements are shown as positioned outside of the antenna volume. Each parasitic element is coupled to a distinct ATM 208*a*; 208*b*; 208*c*; and 208*n*, and each of the ATM's are further coupled to the baseband 211 or other processor having an algorithm 212 for controlling the parasitic element function. Each ATM is further coupled to the filter circuit 205, which incorporates a proximity sensing circuit 206 and an algorithm 207 for sensing capacitive load on the parasitic element as a mechanism for sensing proximity of user extremities. As in the example of FIG. 1, each of the ATMs 208(*a, b, c . . . n*) individually comprises a switch 209(*a, b, c . . . n*) and one or more tunable components including tunable capacitors 210(*a, b, c . . . n*), tunable inductors, or tunable phase shifters. The tunable components and baseband control signals are coupled to a parasitic element through a respective switch within the ATM.

Figure 3:
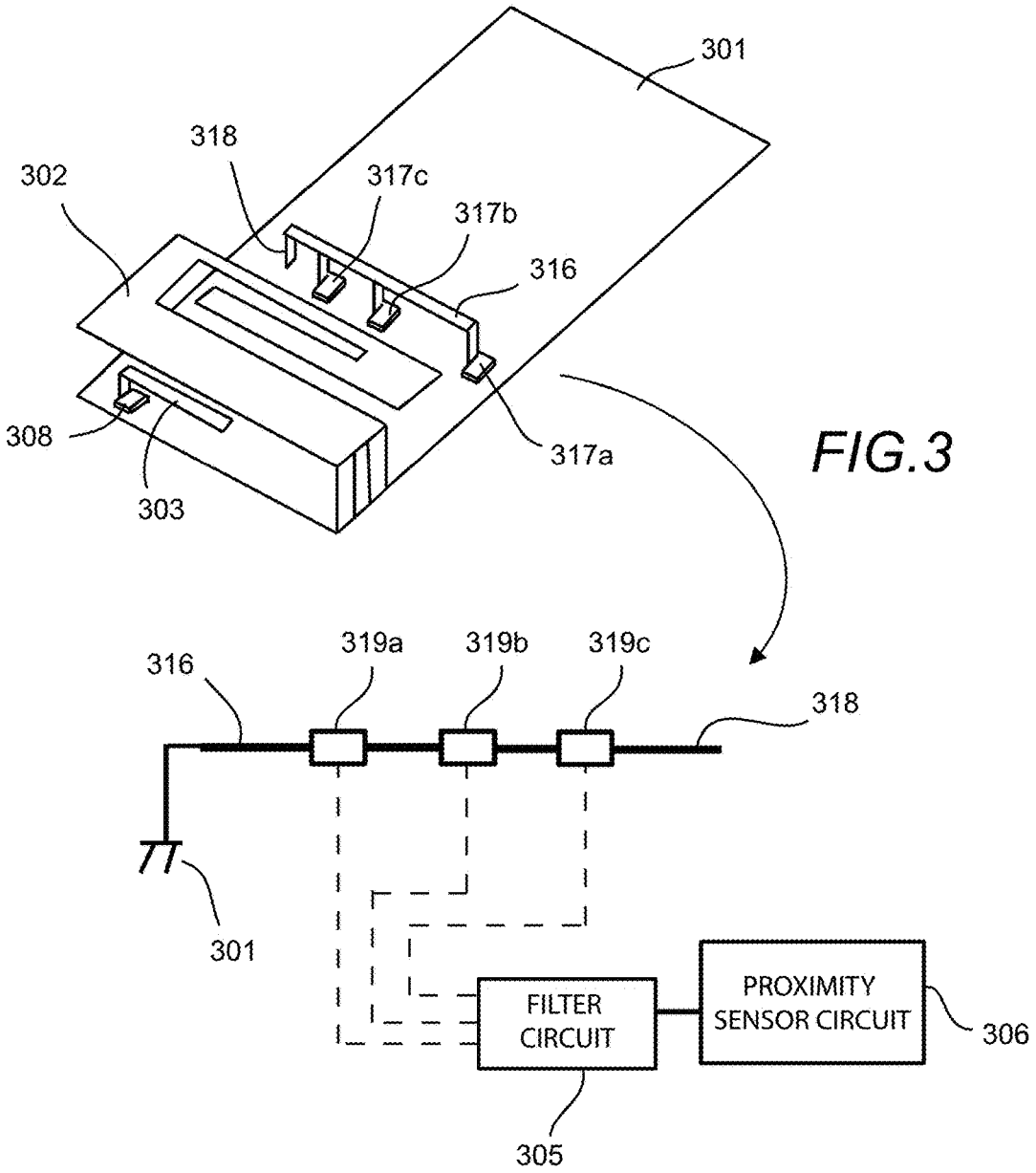
FIG. 3 shows an antenna with proximity sensor function in accordance with another embodiment.

FIG. 3 shows an antenna with proximity sensor function in accordance with another embodiment. Here, first parasitic element 303 and ATM 308 are positioned beneath an antenna element 302 and within the antenna volume, as above, and a second parasitic element is positioned outside of the antenna volume. The second parasitic element comprises a plurality of portions, including a first portion 316 and a second portion 318, the first portion 316 is coupled to the ground plane at a first switch 317*a*, and the second portion 318 is isolated from the ground plane. Multiple portions can be integrated into the second parasitic for additional control; however, three portions are shown here, each portion coupled to the ground plane at a distinct switch (317*a*; 317*b*; 317*c*), and the terminal end of the second parasitic element 318 is isolated from the ground plane 301. Each of the switches is further coupled to a corresponding tunable component 319(*a-c*), and the tunable components are coupled to the filter circuit 305, which is further coupled to a proximity sensing circuit 306 and algorithm 307 as above.

Figure 4:
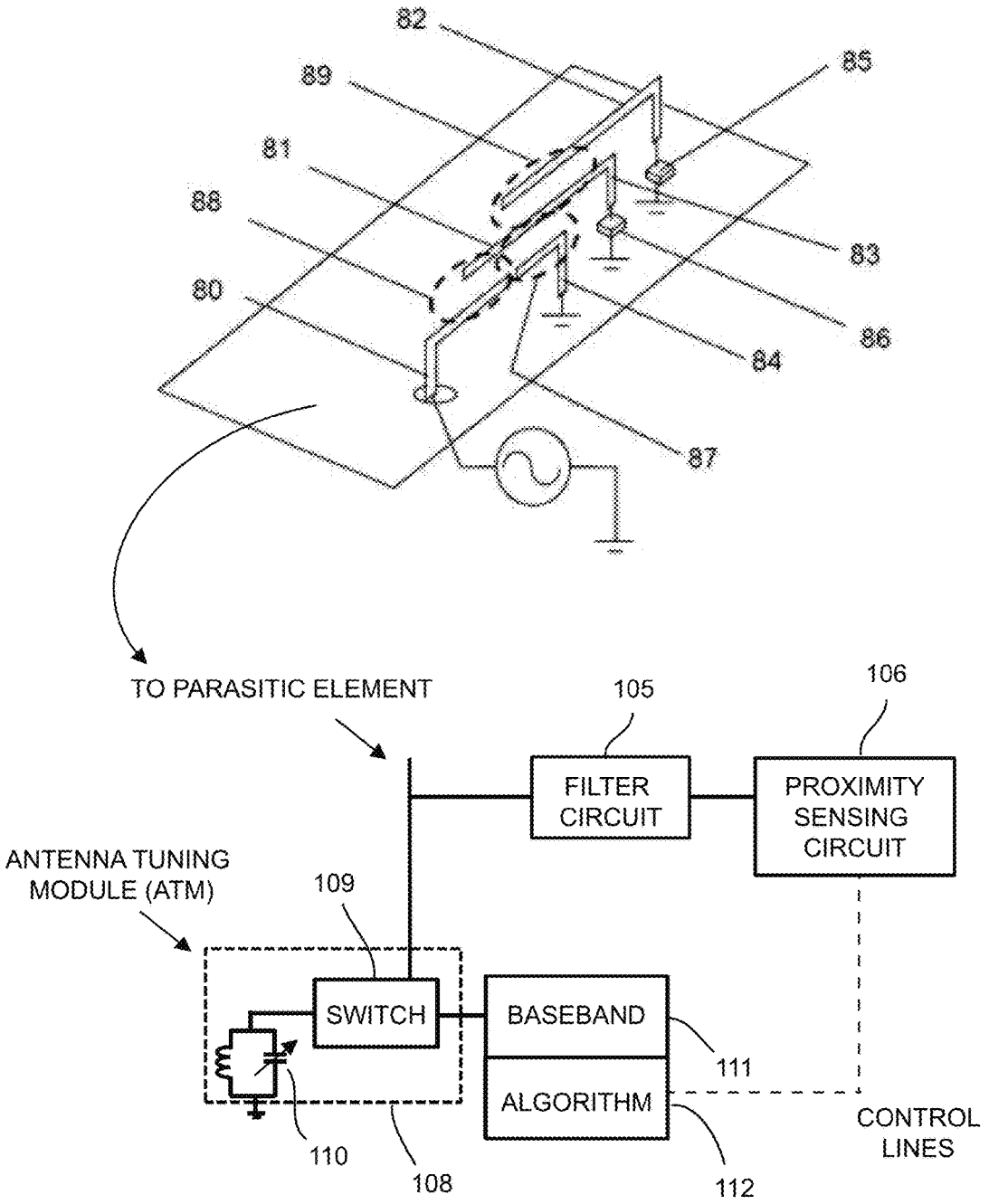
FIG. 4 shows an antenna with proximity sensor function in accordance with another embodiment.

FIG. 4 shows an antenna with proximity sensor function in accordance with another embodiment. The antenna includes a driven element 80 coupled to a second element 81 that is connected to ground via a component 86. If the component 86 is passive (inductor, capacitor, resistor) it will create a fixed frequency response at the coupling region 88. If the component is tunable (tunable capacitor, varactor diode, etc.) then the frequency response can be dynamically tuned (in real time). Element 81 forms a coupling 87 with element 84 that is connected to ground. The frequency of this coupling region 87 will be dependent upon the amount of overlap and separation distance of the elements 81, 84 and the driven element 80. Another coupling region 89 is formed by elements 81 and 82. Both elements are connected to ground by components 85 and 86. Each of elements 81, 82, and 84 are "parasitic elements" as they associate with the driven element 80 to form resonances. One or more of the parasitic elements can be coupled to a circuit as shown, i.e. a filter circuit, proximity sensing circuit, antenna tuning module, baseband and algorithm. In this regard, the antenna with proximity sensor function can be integrated with a proximity sensing circuit similar to the other embodiments disclosed herein.

Figure 5:
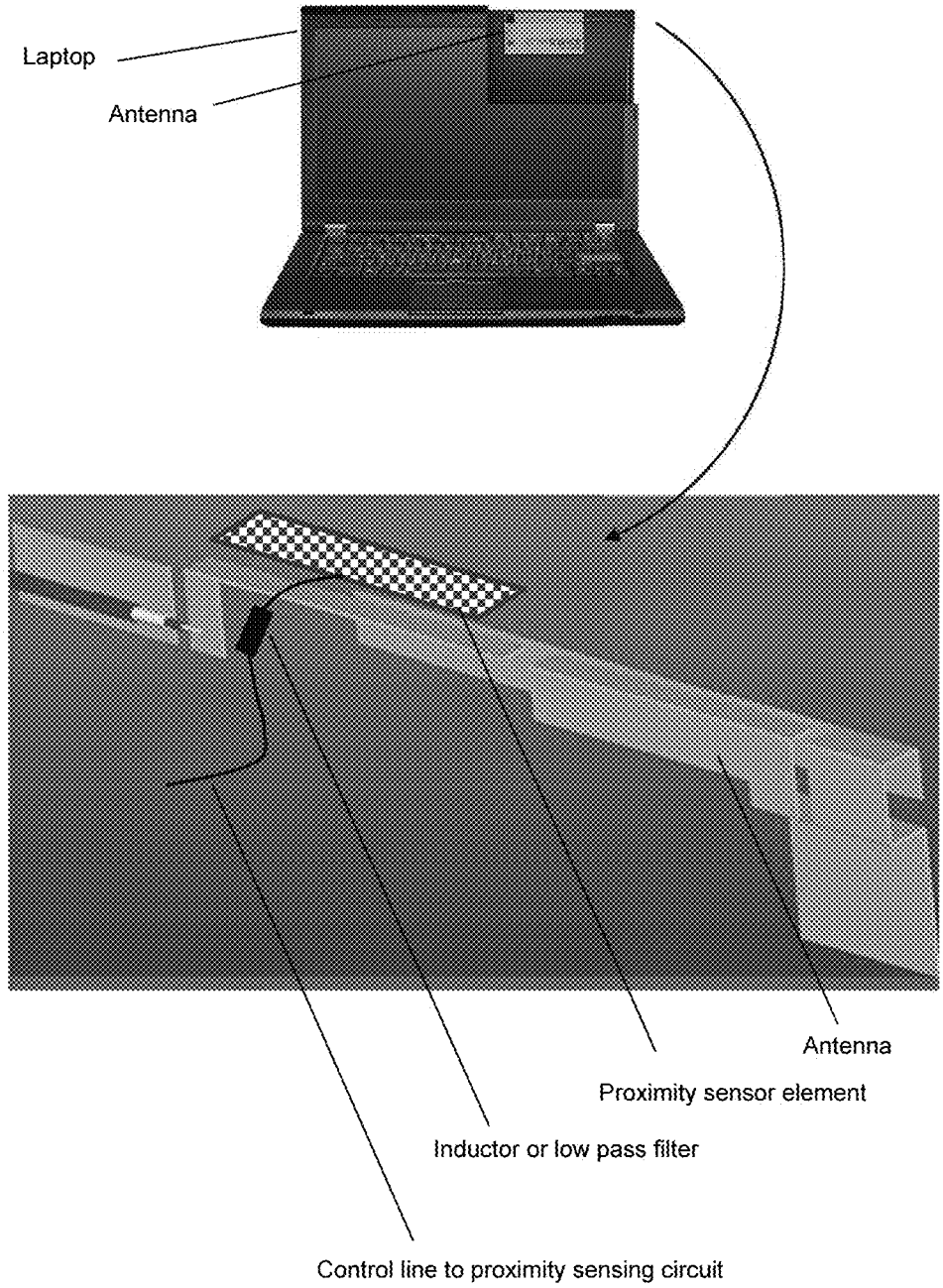
FIG. 5 shows an antenna with proximity sensor function embodied in a laptop computer.

FIG. 5 shows an antenna with proximity sensor function embodied in a laptop computer. The laptop includes an antenna disposed about a perimeter of the lapto screen (although other positions are possible). The antenna includes a proximity sensor element, which is coupled to a control line and proximity sensing circuit. An inductor or low pass filter, or both, can be implemented at the control line.

Figure 6:
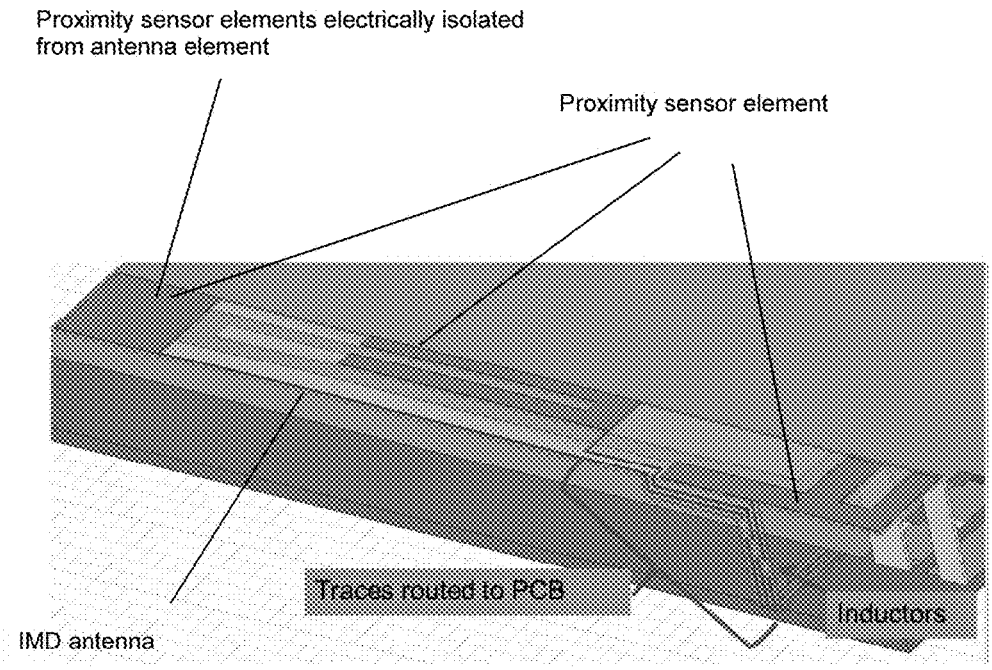
FIG. 6 shows an example of an antenna with integrated proximity sensors.

FIG. 6 shows an example of an antenna with integrated proximity sensors. The antenna includes a plurality of proximity sensor elements. The proximity sensor elements are electrically isolated form the antenna element. In this example, an isolated magnetic dipole antenna is used; however other antenna elements may be similarly implemented with the proximity sensor elements. Traces are used to connect the proximity sensor elements to a proximity sensing circuit. Inductors are shown positioned on the traces for varying an impedance thereon.

Figure 7:
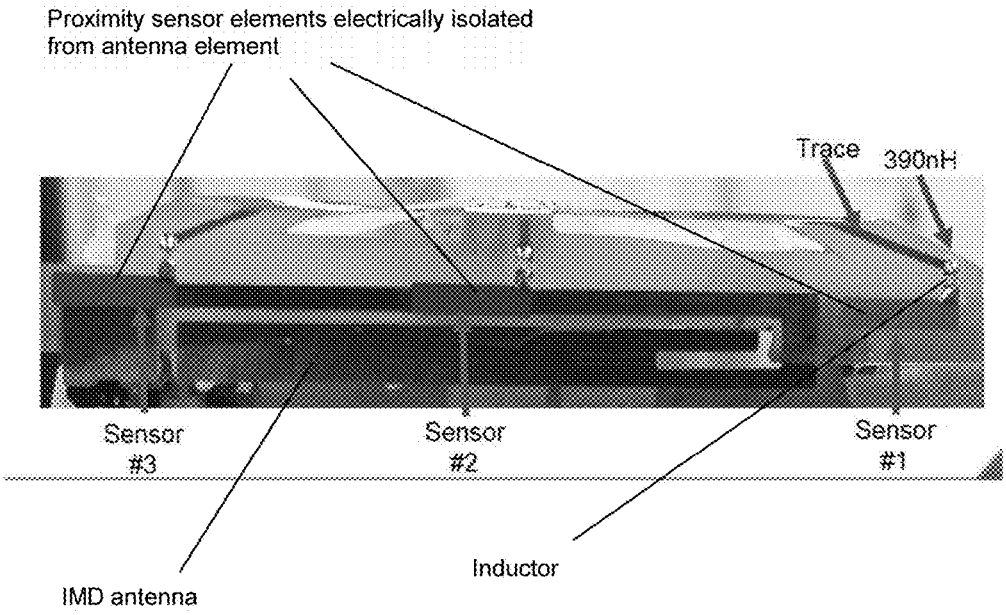
FIG. 7 shows another example of an antenna with integrated proximity sensors.

FIG. 7 shows another example of an antenna with integrated proximity sensors. Flex circuit material is used to position three proximity sensors on an antenna element. The proximity sensor elements are electrically isolated from the antenna element. The three proximity sensors are disposed along a length of the IMD element, and each connected to a trace or control line for coupling to a proximity sensing circuit. Inductors, here a 390nH inductor, are coupled to each trace.

In certain embodiments, proximity sensor loading states are surveyed and used to determine when and to what degree to alter the reactance at the junction of or along the parasitic element to optimize the frequency response and/or the impedance properties of the antenna system. An algorithm or look-up table is configured to relate proximity sensor loading states to reactance required to alter antenna characteristics.

In some embodiments, an antenna with proximity sensor function includes: an antenna element coupled to a ground plane and forming an antenna volume therebetween; a tuning circuit at the feed point or input of the antenna, with the tuning circuit comprising one or multiple components capable of varying impedance; a conductor coupled to the antenna element; and a filtering circuit coupled to the conductor, wherein the filtering circuit further couples to a proximity sensing circuit. The conductor coupled to the antenna forms a proximity sensor; an algorithm resident in memory, with this algorithm configured to relate proximity sensor loading states and impedance tuning states of the antenna, providing the capability to alter the antenna impedance characteristics based on proximity sensor status.

In certain embodiments, the antenna components inherently provide the proximity sensor function, thereby eliminating the cost for additional capacitive sensors. Moreover, less energy is consumed by the system with less components for distributing power. Smaller antenna device form is achieved by reduced size due to reduced componentry requirements.

What is claimed is:

1. An antenna with proximity sensor function, comprising:

an antenna element;

an impedance tuning circuit coupled to a feed of the antenna element;

a first conductor positioned in proximity to the antenna element and electrically isolated therefrom;

a plurality of switches each positioned along the first conductor, each of the switches being independently coupled to ground and further coupled to the filtering circuit, a length of the first conductor being configurable via the switches and the filtering circuit;

the first conductor coupled to an inductor or a filtering circuit;

the filtering circuit being further coupled to a proximity sensing circuit; and a processor coupled to each of the proximity sensing circuit and the impedance tuning circuit;

wherein the processor is configured to receive signals from the proximity sensing circuit and at least the first conductor coupled therewith, and based on the signals from the proximity sensing circuit the processor being configured to: (i) vary a tuning state of the impedance tuning circuit; (ii) vary an impedance associated with the first conductor; or (iii) a combination thereof.

2. The antenna of claim 1, wherein the antenna element comprises an isolated magnetic dipole antenna element.

3. The antenna of claim 1, wherein the impedance tuning circuit comprises one or more voltage-controlled tunable components.

4. The antenna of claim 3, wherein the one or more tunable components comprises a tunable capacitor.

5. The antenna of claim 3, wherein the one or more tunable components comprises a switch.

6. The antenna of claim 1, wherein the filtering circuit comprises an inductor.

7. The antenna of claim 1, wherein the antenna is configured to assess information from a proximity sensor, the proximity sensor formed by the first conductor, filtering circuit, and proximity sensing circuit, and based on the information the antenna is configured to adjust an impedance at the feed of the antenna element.

8. The antenna system of claim 1, wherein the antenna element is disposed on a flexible substrate.

9. The antenna system of claim 1 comprising two or more conductor elements, each of the conductor elements coupled to an inductor or filtering circuit and further coupled to the proximity sensing circuit.

* * * * *